US006508005B2

(12) United States Patent
Springer

(10) Patent No.: US 6,508,005 B2
(45) Date of Patent: Jan. 21, 2003

(54) SOLO PLANE PIN HEAD BOW SIGHT

(75) Inventor: Eric C. Springer, Auburn, NY (US)

(73) Assignee: Copper John Corporation, Auburn, NY (US)

( * ) Notice: Subject to any disclaimer, the term of this patent is extended or adjusted under 35 U.S.C. 154(b) by 8 days.

(21) Appl. No.: 09/768,467

(22) Filed: Jan. 25, 2001

(65) Prior Publication Data

US 2001/0032393 A1 Oct. 25, 2001

Related U.S. Application Data

(60) Provisional application No. 60/178,143, filed on Jan. 26, 2000.

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS 3,310,875 A * 3/1967 Kowalski ..... 33/265
3,747,222 A * 7/1973 Benoit ..... 33/265
4,580,349 A * 4/1986 Webb et al. ..... 33/265
4,928,394 A * 5/1990 Sherman ..... 33/265
5,080,084 A * 1/1992 Kendall et al. ..... 124/87
5,168,631 A * 12/1992 Sherman ..... 33/265
5,201,124 A * 4/1993 Sherman ..... 33/265
5,220,907 A * 6/1993 Lonsdale ..... 124/87
5,228,204 A * 7/1993 Khoshnood ..... 33/265
5,560,113 A * 10/1996 Simo et al. ..... 33/265
5,685,081 A * 11/1997 Winegar ..... 33/265
5,864,958 A * 2/1999 Giddens ..... 33/265
6,000,141 A * 12/1999 Afshari ..... 33/265
6,418,633 B1 * 7/2002 Rager ..... 33/265
6,430,822 B1 * 8/2002 Slates ..... 33/265
2002/0083602 A1 * 7/2002 Slates ..... 33/265

* cited by examiner

*Primary Examiner*—Diego Gutierrez
*Assistant Examiner*—Tania C. Courson
(74) *Attorney, Agent, or Firm*—Bernhard P. Molldrem, Jr.

(57) ABSTRACT

The bow sight of the present invention includes at least one pin that doglegs from one of a multiple set of tracks to align the doglegged pin's head in a common axis with the pin heads of other pins that are positioned in other tracks. Each pin of the bow sight includes an aperture through a pin head that is aligned such that all fiber optic elements received in those apertures align with the archer's line of sight. The pin guard of the bow sight is circular and forms an integral portion of a proper sight picture for an archer.

14 Claims, 2 Drawing Sheets

SOLO PLANE PIN HEAD BOW SIGHT

This Application claims the benefit of Provisional Application No. 60/178,143, filed Jan. 26, 2000.

BACKGROUND OF THE INVENTION

1. Field of the Invention

This invention is related to the field of archery bow sights. In particular, this invention is directed to a sight for an archery bow that maintains the alignment of the pin heads of a bow sight even when the bow twists during a pull of the string on the bow.

2. Description of Related Art

Conventional bow sights include pin heads that do not maintain alignment when the bow twists during a pull on the string of the bow by an archer. When an archer draws back the sting of a bow, torque is exerted upon the bow, which causes the bow to pivot about the archer's grip. A conventional multiple track pin head bow sight experiences a "see-saw " effect such that the pin heads move out of alignment with each other when the bow twists. As the bow twists, each pin rotates away from the archer (in a direction determined by which hand the archer uses to pull) by an amount that is related to the distance from the pivot point (i.e. the archer's grip). In a multiple track pin bow sight, each track is positioned a different distance away from the pivot, therefore, the pins in different tracks have different amounts of rotation and, as a result, move out of alignment with each other.

Conventional multiple track pin bow sights also do not have fiber optic elements which align with each other and with an archer's sight. The degree of brightness of a fiber optic element depends upon the degree of the alignment of that fiber optic element with an archer's line of sight. Therefore, each fiber optic element in a conventional bow sight provides a different level of brightness to the archer's sight.

Additionally, conventional bow sights have pin guards that do not form an integral part of the sighting mechanism for the archer's sight picture. Rather, typical pin guards are simply a mechanism by which the pins are protected from being damaged and they do not function as part of the sight for the purpose of providing a means with which a proper sight picture may be obtained.

SUMMARY OF THE INVENTION

An exemplary embodiment of a bow sight in accordance with the present invention provides multiple tracks with pins that dogleg from each respective track into a common plane and which places all pin heads into alignment with a common axis. The bow sight of the present invention enables the pin heads to remain in alignment although the bow twists during an archer's pull on the bow string.

Another exemplary embodiment of the present invention includes a circular pin guard, which forms an integral portion of a proper sight picture. The inventor discovered that the human brain has a natural preference for aligning an element at the center of a circle. By contrast, the human brain has difficulty aligning an element at the center of any non-circular element. Typically, conventional bow sights use a non-circular pin guard and, as a result, the archer must ignore the pin guard when forming a sight picture. Therefore, the bow sight of the present invention assists the archer in obtaining a correct sight picture. The circular pin guard of this embodiment may include a brightly colored ring to assist in making the pin guard appear as a ring that is highly visible to the archer. The pin guard may be any bright color, such as orange, to make the guard more visible and distinguishable from a background.

Yet, another exemplary embodiment of the present invention aligns all fiber optic elements in the pins with the archer's line of sight to ensure that all fiber optic elements appear equally bright to the archer. By contrast, conventional bow sights have fiber optic elements that are not aligned with the archer. Therefore, the fiber optic elements appear to the archer with different degrees of brightness.

These and other features and advantages of this invention are described in or are apparent from the following detailed description of the preferred embodiments.

BRIEF DESCRIPTION OF THE DRAWINGS

The preferred embodiments of this invention will be described in detail with reference to the following figures, wherein.

DETAILED DESCRIPTION OF THE PREFERRED EMBODIMENTS

Figure 1:
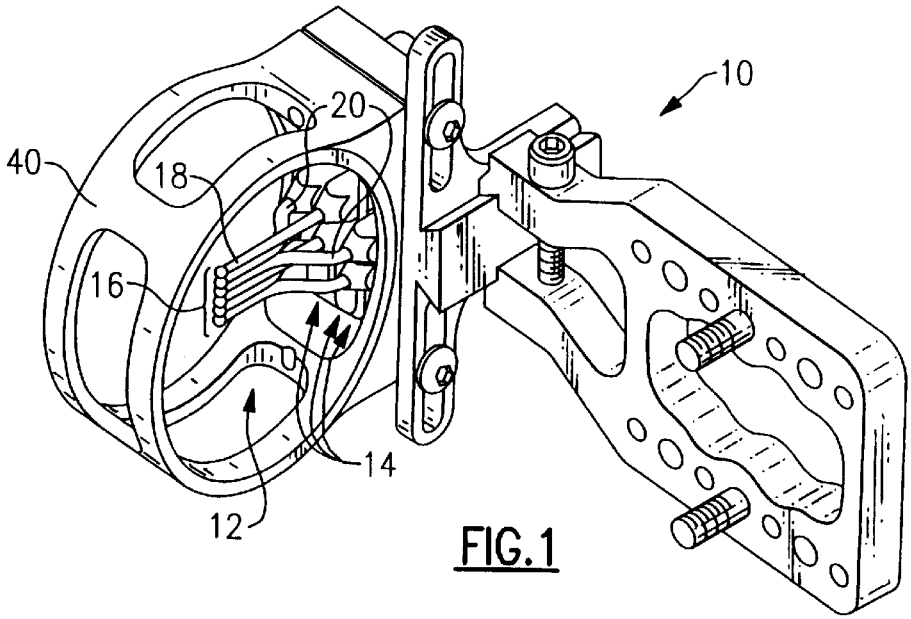
FIG. 1 is a perspective view of an exemplary embodiment of a bow sight in accordance with the present invention.
Figure 2:
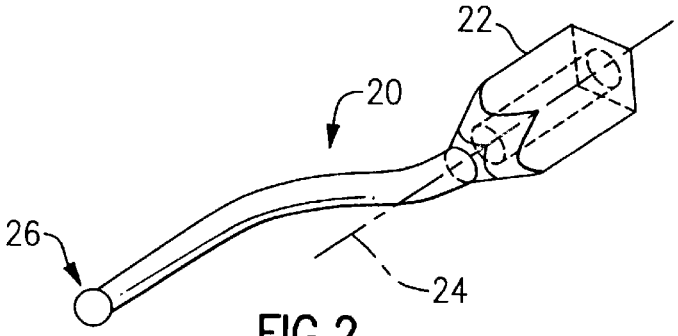
FIG. 2 is a perspective view of a "dog leg" pin of the bow sight of FIG. 1.
Figure 3:
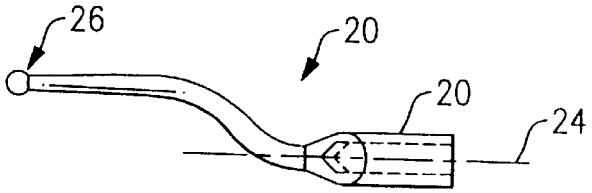
FIG. 3 is a plan view of the pin of FIG. 2.
Figure 4:
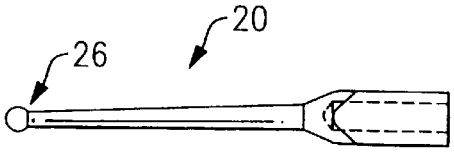
FIG. 4 is an elevation view of the pin of FIG. 2.

FIG. 1 shows a perspective view of one exemplary embodiment of a bow sight 10 in accordance with the present invention. The bow sight 10 includes a set of pins 12 in multiple tracks 14 (here, three pin tracks) with the pin heads 16 aligned in a plane. The bow sight 10 has two straight pins 18 and four dogleg pins 20. The dogleg pins 20 in the rear track extend forward and the dogleg pins 20 in the forward track extend rearward into alignment with the straight pins 18. In the exemplary embodiment of the bow sight 10, the pin heads are also aligned with a common vertical axis. The configuration of the dogleg pins 20 enable the pin heads 16 to remain in alignment even though the bow twists when an archer draws the string.

FIGS. 2–5 show an exemplary embodiment of a dogleg pin 20 in accordance with the present invention. The pin 20 is referred to as a "dogleg" pin because the pin has a base 22 that is aligned with an axis 24 and a pin head 26 that is offset from that axis 24. The pin head 26 is offset by an amount such that the pin head 26 will align in a common axis with the pin heads 16 from all other pins when installed in the bow sight 10.

Figure 6:
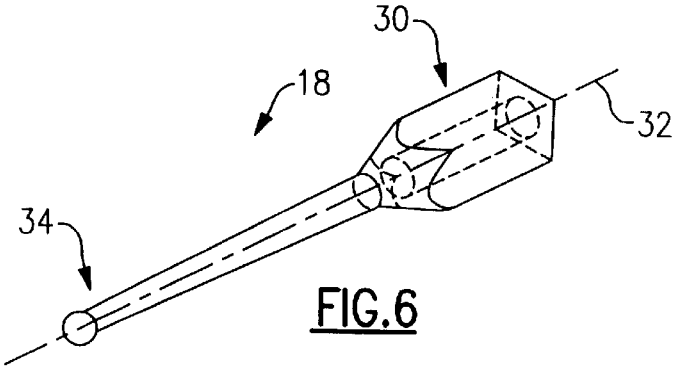
FIG. 6 is a perspective view of a straight pin of the bow sight of FIG. 1.
Figure 7:
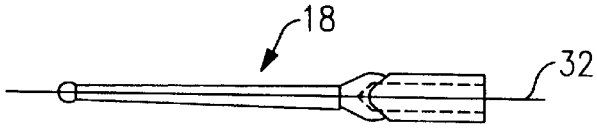
FIG. 7 is a plan view of the pin of FIG. 6.
Figure 8:
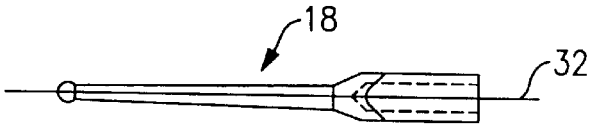
FIG. 8 is an elevation view of the pin of FIG. 6.

FIGS. 6–8 show an exemplary embodiment of a straight pin 18 in accordance with the present invention. The straight pin 18 is straight because the pin 18 has a base 30 that has an axis 32 that is aligned with the pin head 34. As shown in FIG. 1, the straight pin 18 is positioned in the center track of the multiple tracks 14 of the bow sight 10.

Figure 5:
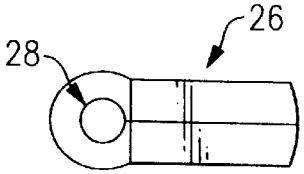
FIG. 5 is a detail view of the pin head of the pin of FIG. 2.

As shown in FIG. 5, the pins 18 and 20 have apertures 28 that are each adapted to receive a fiber optic element (not shown). The apertures 28 in each of the pins 18 and 20 of the exemplary embodiment are adapted to align the fiber optic elements in a common plane such that each fiber optic element appears to have the same degree of brightness to an archer in a sight picture.

Figure 9:
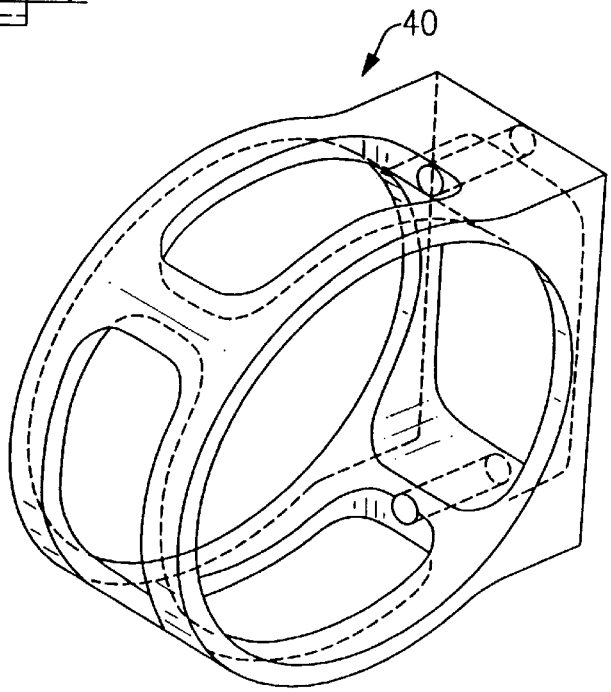
FIG. 9 is a perspective view of the pin guard of the bow sight of FIG. 1.
Figure 10:
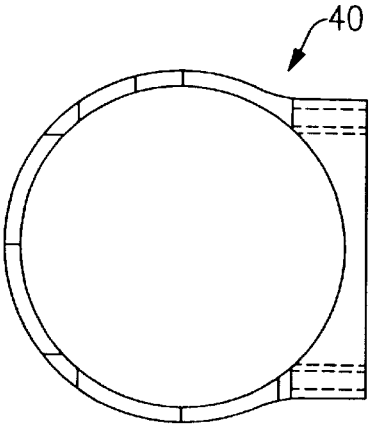
FIG. 10 is an elevation view of the pin guard of FIG. 10.

FIGS. 9 and 10 show the pin guard 40 of the exemplary bow sight 10 of FIG. 1 in accordance with the present invention. As shown in FIG. 10, the pin guard 40 is circular. As explained above, the circular pin guard 40 forms an integral portion of the sight picture for an archer using the bow sight 10 of the present invention. The inventor discovered that the human mind works in such a manner that it is natural for an archer to align elements (such as pins) within a circular pin guard. Thus the circular pin guard 40 forms a circular viewing aperture and defines an integral portion of the sight picture to make it easier for an archer to obtain a proper sight picture. In a preferred embodiment, the pin guard 40 may be colored about its periphery to further enable the archer to distinguish the pin guard 40 form the background that is visible around the target, and to assist the archer in forming a proper sight picture. The pin guard 40 may include any color such as bright orange color, however, it is understood that any color may be used that will assist in making the pin guard 40 in being distinguishable from a background. The color may be applied in any manner such as by, for example, a sticker or paint, or the like and still form a part of the present invention.

While the bow sight 10 described above has three tracks 14, it is understood by those of ordinary skill in the art that a bow sight with any number of multiple tracks is within the scope of this invention. Additionally, while the bow sight 10 described above has a straight pin 18 positioned in the center track, one of ordinary skill in the art understands that a straight pin may be positioned in any track. As long as a bow sight has a pin with a dogleg configuration and all the pin heads are aligned with each other, those of ordinary skill in the art understand that such a bow sight falls within the scope of this invention.

While this invention has been described with reference to the specific embodiments outlined above, many alternatives, modifications and variations are and will be apparent to those skilled in the art. Accordingly, the preferred embodiments described above are illustrative and are not limiting. Various changes may be made without departing from the spirit and scope of the invention.

What is claimed:

1. A bow sight comprising:

a pin holder having a plurality of pin tracks spaced from one another in a fore-and-aft direction; and a plurality of pins distributed among said plurality of pin tracks, with at least one of said pins being adjustably mounted in each of said tracks, wherein each of said pins has a proximal end member that is adjustably mounted in an associated one of said pin tracks, and a distal end portion thereof that extends distally away from said pin holder, each said distal portion having a pin head disposed at an end thereof; and wherein the pins that are mounted in at least one of said pin tracks have an offset between the distal end portion and the proximal end member thereof, such that the pin heads of all the pins are aligned along one common vertical axis.

2. The bow sight of claim 1, wherein each of said plurality of said pins includes a base that is slidably mounted in a respective one of said plurality of pin tracks.

3. The bow sight of claim 1, wherein at least one of said plurality of pins is shaped in a dog-leg.

4. The bow sight of claim 3, wherein another one of said plurality of pins is straight with no offset.

5. The bow sight of claim 1, wherein at least one of said plurality of pins further includes an aperture passing transversely through its pin head and a fiber optic element mounted in said aperture.

6. The bow sight of claim 5, further comprising another of said plurality of pins including an aperture transversely through its pin head and another fiber optic element mounted in said aperture of said other pin and wherein said fiber optic elements have ends that are axially aligned with a plane that is approximately aligned with an archer's sight picture.

7. The bow sight of claim 1 wherein the at least one pin in a respective one of said pin tracks has an offset that is different from the at least one pin in each of the other pin tracks.

8. The bow sight of claim 1 wherein there are three of said pin tracks.

9. The bow sight of claim 1 wherein the at least one pin mounted in one of the pin tracks has an offset in one direction, and the at least one pin in another of said pin tracks has an offset in an opposite direction.

10. A bow sight through which an archer aims at a target situated in a visual background, comprising:

a pin holder having a plurality of pin tracks;

a plurality of pins distributed among said plurality of pin tracks, each said pin having a proximal end member that is adjustably mounted in one of said pin tracks and a distal portion that extends in a direction away from said pin holder, each said pin having a pin head at the distal end thereof; said distal ends of at least some of said pins being offset with respect to their proximal end member such that the heads of all of said pins lie along a common vertical axis; and a pin guard attached onto said pin holder and surrounding said plurality of pins and forming a closed visual aperture around said plurality of pins to define a sight picture for the archer, the pin guard having a front surface facing the archer, and said front surface of said pin guard having a predetermined distinctive color applied thereto, the color being adapted to distinguish the pin visual aperture of the pin guard from said visual background.

11. The bow sight of claim 10, wherein said pin guard is substantially circular.

12. The bow sight of claim 10, wherein the distinctive color applied onto the front surface of said pin guard is a bright color.

13. The bow sight of claim 12, wherein said bright color is a high-visibility orange.

14. The bow sight of claim 12, wherein said distinctive color is applied around the entire front surface of said pin guard such that a ring of said distinctive color surrounds the entire periphery of said sight picture.

* * * * *

UNITED STATES PATENT AND TRADEMARK OFFICE

CERTIFICATE OF CORRECTION

PATENT NO. : 6,508,005 B2
DATED : January 21, 2003
INVENTOR(S) : Eric C. Springer It is certified that error appears in the above-identified patent and that said Letters Patent is hereby corrected as shown below:

Title page, Item [54] and Column 1, line 1,
"SOLO PLANE PIN HEAD BOW SIGHT" should read -- MULTIPLE PIN-TRACK BOW SIGHT HAVING OFFSET SIGHT PINS AND CIRCULAR PIN GUARD --

Column 1,
Line 18, "sting" should read -- string --

Column 3,
Line 21, "form" should read -- from --

Signed and Sealed this

Thirteenth Day of May, 2003

JAMES E. ROGAN
*Director of the United States Patent and Trademark Office*